US010150645B1

(12) United States Patent
Pei et al.

(10) Patent No.: US 10,150,645 B1
(45) Date of Patent: Dec. 11, 2018

(54) ROTATIONAL HOSE REEL

(71) Applicant: Liberty Garden Products, Inc., Kernersville, NC (US)

(72) Inventors: Billy Pei, Shenzhen (CN); Kent Southard, Kernersville, NC (US)

(73) Assignee: Liberty Garden Products, Inc., Kernersville, NC (US)

( * ) Notice: Subject to any disclaimer, the term of this patent is extended or adjusted under 35 U.S.C. 154(b) by 281 days.

(21) Appl. No.: 15/213,977

(22) Filed: Jul. 19, 2016

Related U.S. Application Data

(62) Division of application No. 14/284,997, filed on May 22, 2014, now Pat. No. 9,422,132.

(60) Provisional application No. 61/826,245, filed on May 22, 2013.

(51) Int. Cl.
*B65H 75/14* (2006.01)
*B65H 75/44* (2006.01)
*B65H 75/40* (2006.01)

(52) U.S. Cl.
CPC ..... *B65H 75/4463* (2013.01); *B65H 75/14* (2013.01); *B65H 75/403* (2013.01); *B65H 75/4478* (2013.01); *B65H 75/4492* (2013.01); *B65H 2701/33* (2013.01); *B65H 2701/533* (2013.01)

(58) Field of Classification Search
CPC .. B65H 75/14; B65H 75/403; B65H 75/4463; B65H 75/4492; B65H 75/4478
See application file for complete search history.

(56) References Cited

U.S. PATENT DOCUMENTS

| | | | | |
|---|---|---|---|---|
| 446,745 | A | 2/1891 | Schenck | 137/355.26 |
| 1,322,604 | A | 11/1919 | Nuhring | 137/355.18 |
| 2,805,100 | A | 9/1957 | Shaver | 137/355.26 |
| 3,490,715 | A | 1/1970 | Nicpon | 242/385.3 |
| 4,212,421 | A | 7/1980 | Scott | 226/127 |
| 4,700,737 | A | 10/1987 | Nelson | 137/355.27 |
| 4,793,376 | A | 12/1988 | Hare | 137/355.23 |
| 5,109,882 | A | 5/1992 | Eley | 137/355.21 |
| 5,179,972 | A | 1/1993 | Eley | 137/355.19 |
| 5,209,420 | A | 5/1993 | Simmons et al. | 242/399.2 |
| 5,330,121 | A | 7/1994 | Eley | 242/401 |
| 7,344,103 | B1 | 3/2008 | Eley | 242/279 |
| 7,377,289 | B1 | 5/2008 | English et al. | 137/355.2 |
| 7,669,795 | B2 | 3/2010 | Brown | 242/397 |
| 8,353,307 | B2 | 1/2013 | Blaszczak et al. | 137/355.27 |
| 2008/0066808 | A1 | 3/2008 | Stein | 137/355.12 |

*Primary Examiner* — Sang K Kim
(74) *Attorney, Agent, or Firm* — MacCord Mason PLLC

(57) ABSTRACT

An improved apparatus and method for a hanging rotational hose reel includes a bracket for hanging the hose reel, a spool for winding a hose about a first rotational axis, a frame for supporting the spool, and a rotational assembly connecting the bracket and the frame. The rotational assembly allows rotation of the spool about a second rotational axis. The hanging hose reel may be secured to a surface or may hang from a wagon and/or stand.

13 Claims, 14 Drawing Sheets

ROTATIONAL HOSE REEL

BACKGROUND

This disclosure relates generally to hose reels, and more specifically to free-hanging rotatable hose reels, particularly for residential use. Almost anyone having experience with hoses, such as garden hoses or air hoses, understands some of the problems associated with the use and storage of such hoses. Storing hoses in order to avoid an unsightly mess and/or the formation of kinks that may impede flow through the hose is often difficult. It is well known that one way to address such problems is to provide a support about which the hose is wound to permit easy storage. Further, it is desirable if the support allows the hose to remain partially wound when in use, so the user does not have to unwind and rewind the entire hose each time it is used.

As a result, hose reels and carts are known in the art to wind and store unattractive, and otherwise unmanageable hoses, such as air and water hoses. Some hose reels may be modular carts, while others are wall-mounted. Modular carts are often on wheel bases and may offer some maneuverability when the hose is in use. However, modular carts are relatively expensive, large and bulky, requiring additional storage space, may still tangle the hose and traditionally are most useful when multiple faucets must be regularly accessed. Many users, however, use a hose mostly at a single faucet and do not care for the expense or bulk associated with the traditional carts.

Wall-mounted supports and hose reels are one alternative to the carts. However, many users of wall-mounted hose reels may find that the wall-mounted reels that are available offer very limited flexibility as to the movement of the hose by the user, particularly when it comes to the range of peripheral motion toward the lateral edges of a mounted-hose reel. Applicant finds that this limited range of motion may also cause kinks or bends in the hose that make it difficult to maneuver and/or damage the hose in the same manner that user was trying to prevent by the use of the hose reel. It is to these and other problems that this disclosure is directed.

SUMMARY OF THE INVENTION

The present disclosure is directed to a hanging hose reel apparatus including a bracket for hanging the hose reel, a spool for winding a hose about a first rotational axis, a frame for supporting the spool, and a rotational assembly connecting the bracket and the frame. The rotational assembly allows a rotation of the spool about a second rotational axis. The bracket, in one embodiment, is a mount for securing the hanging hose reel to a surface. In another embodiment, the bracket attaches to a stand for supporting the hanging hose reel.

In other examples, a hanging hose reel kit includes a suspension bracket for hanging the hose reel, a spool for winding a hose about a first rotational axis, a frame for supporting the spool, and a rotational assembly for allowing free rotation of the spool about a second axis without movement of the shelf.

The disclosure also includes a method of hanging a rotational hose reel, including: providing a bracket for hanging the hose reel, including a spool for winding a hose about a first rotational axis, forming a frame for supporting the spool, and attaching a rotational assembly that connects the bracket and the frame. The rotational assembly allows a rotation of the spool about a second rotational axis. The method may also include allowing a spool rotational selection of between 0 and 360 degrees about the second axis from a stationary setting.

These and other aspects of the present invention will become apparent to those skilled in the art after a reading of the following description of the preferred embodiment when considered with the drawings.

DESCRIPTION OF THE PREFERRED EMBODIMENTS

Figure 1:
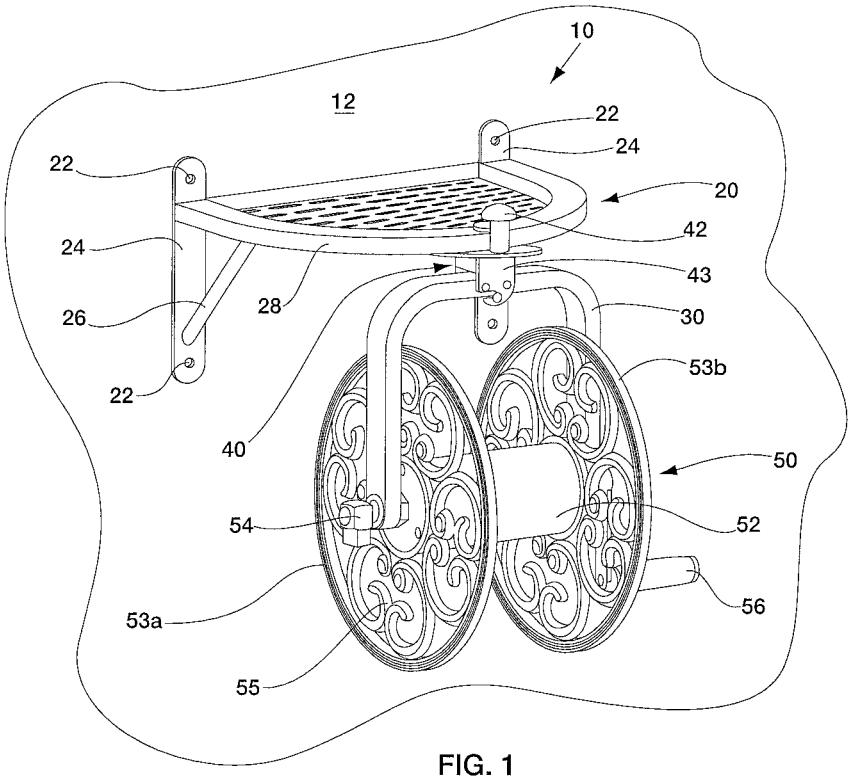
FIG. 1 is a perspective view of one example of a hanging hose reel of the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIGS. 1 through 4 in particular, it will be understood that the illustrations are for the purpose of describing a preferred embodiment of the invention and are not intended to limit the invention thereto. FIG. 1 shows a hanging hose reel system 10 including a suspension shelf 20, a spool 50, a yoke or frame 30 and a vertical axis rotational assembly 40. The suspension shelf 20 attaches to the rotational assembly 40, which in turn, suspends the frame 30. Frame 30 supports a spool 50 in a manner so that the spool 50 can rotate in the frame or yoke 50.

The spool 50 may include typical elements, such as, a handle 56, a hub 52, end plates 53*a*, 53*b* and a leader hose attachment 54. Attachment 54 provides a path through the hub 52 to a wound-hose attachment 54*a*, seen in FIG. 4. Spokes 55 may take on any arrangement, examples of which may be seen in FIGS. 1 and 5. Spool 50 is designed to allow a hose to connect to a faucet or outlet, for example, for conducting water or air and to allow the hose to stay partially wound or attached during use. Such spools and their lead hose arrangements are known and are conventional in the art.

Figure 3:
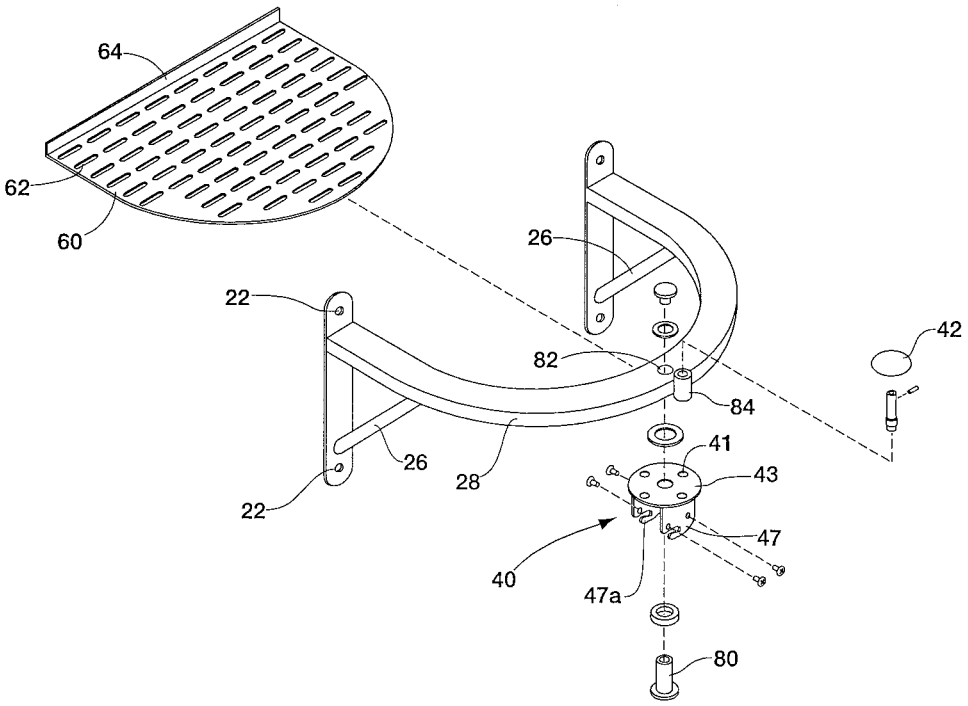
FIG. 3 is an exploded view of one example of a mounted suspension shelf and a rotational assembly of the mounted hose reel of FIG. 1.
Figure 6A:
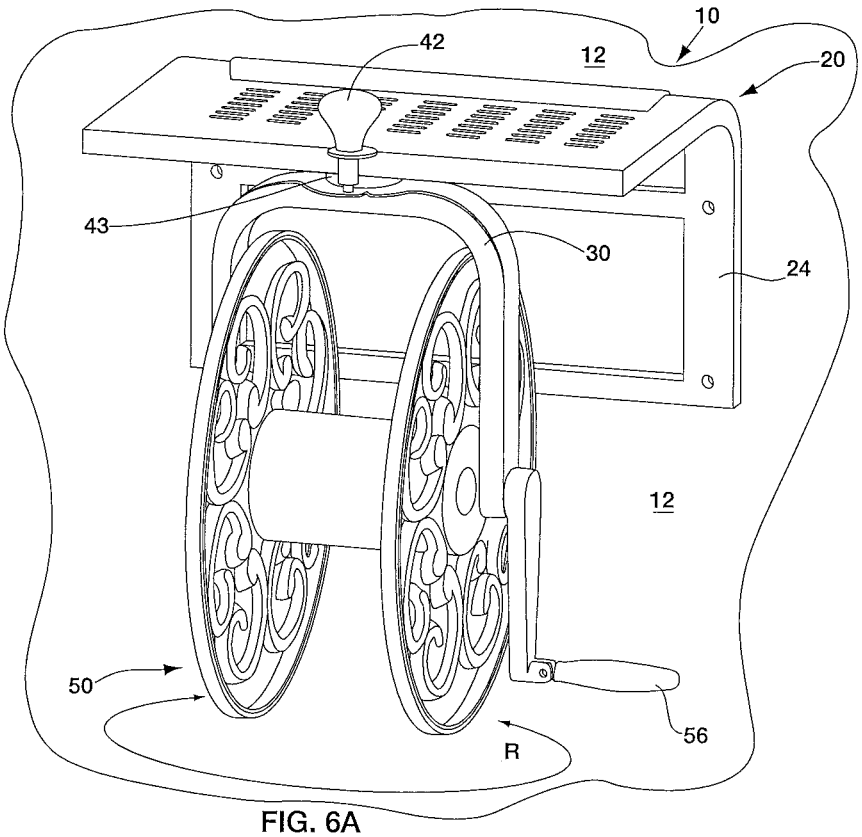
FIG. 6A-6C shows further examples of the rotation of the spool of a hose reel of the present disclosure.
Figure 8:
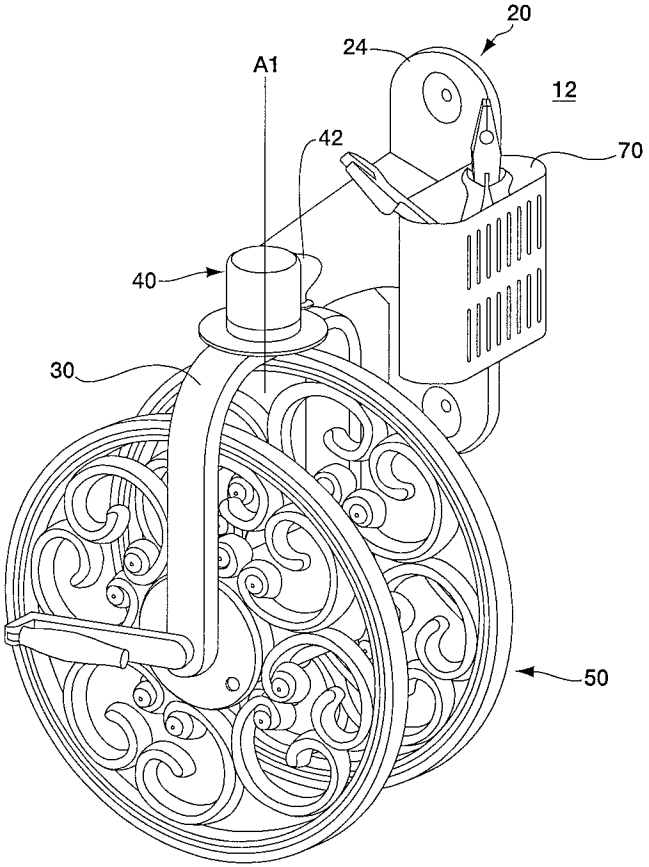
FIG. 8 is another example of a hanging hose reel of the present disclosure.

The suspension shelf 20 may take on various shapes, some examples of which may be seen in FIGS. 1, 6A and 8. Suspension shelf 20 may include one or more mount brackets 24. Mount brackets 24 may include one or more suspension holes 22 for receiving, for example bolts, for securing suspension shelf 20 against a wall 12. Additionally, shelf 20 may include support braces 26. As seen in FIG. 3, suspension shelf 20 may include a plate 60. Plate 60 may have perforations 62. Plate 60 may include a lip 64. Plate 60 typically adjoins mount 28 and is secured into place when suspension shelf 20 is mounted, for example, to a support 12, such as a wall, wagon or stand. The plate 60 may be received within a slot inside of mount 28, may be a part of mount 28 or may be attached to the mount. The suspension shelf may also include other attachments, for example, a container 70 as seen in FIG. 8. Hose reels can become heavy when loaded with a hose, particularly when filled with water while the hose is still partially wound on the reel. A sturdy bracket and shelf is desirable, and allowing movement or rotation may contribute to instability in traditional standing, carts and/or wall mounted hose reels.

Figure 11:
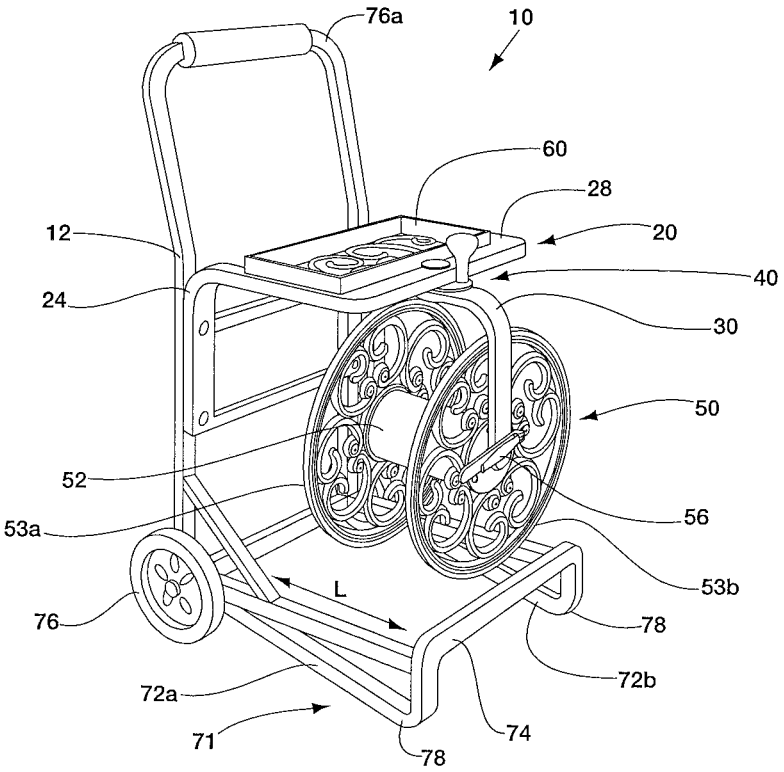
FIG. 11 is a perspective view of another example of a hanging hose reel of the present disclosure.
Figure 12:
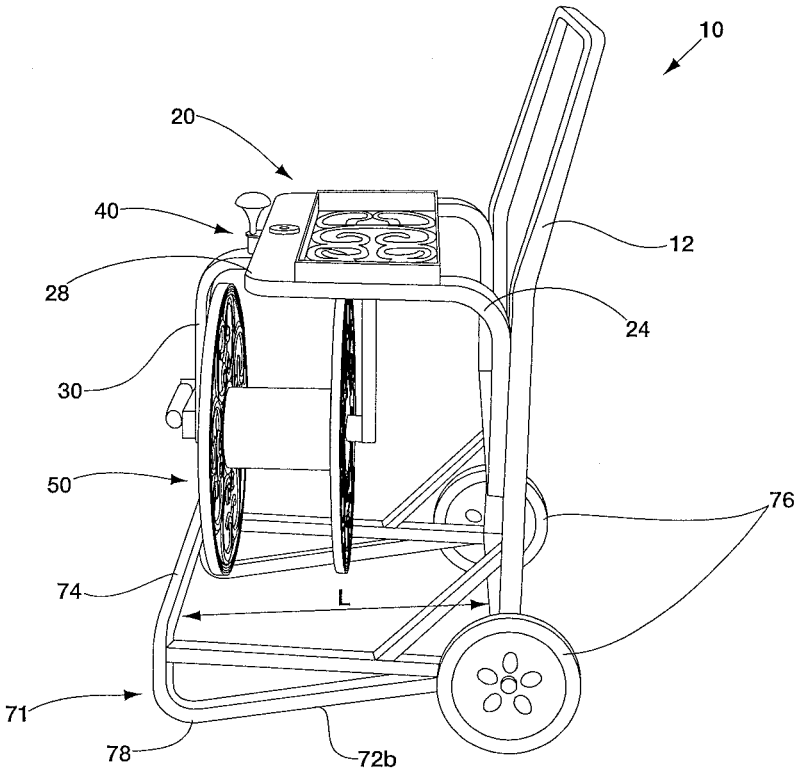
FIG. 12 is a side view of one example of the hanging hose reel of FIG. 11, supported by a stand/wagon.

In another embodiment, suspension shelf 20 may support hanging hose reel 10 on a stand or a wagon, as seen in FIGS. 11 and 12. In this example, one or more mount brackets 24 may secure the hose reel to a wagon or a stand. The hanging hose reel may be more difficult to balance when not secured to a surface such as a wall. When the hose is on the spool, the weight of the hose may contribute to instability. The hanging hose reel, in one example, when attached to a cart, stand or wagon, may include a stabilizer base 71. Stabilizer 71 may include stabilizer bars 72*a* and/or 72*b*. The stabilizer may include a crossbar 74 that attaches to the stabilizer bars 72*a* and 72*b*. Stabilizer 71 may also include stops 78 on which the weight of the cart is distributed. On the side of the stabilizer away from stops 78, wheels 76 are included on the stabilizer base 71 to allow the hose reel wagon to be pulled over the ground by a person manipulating the handle 76*a*. Stabilizer 71 may have a length L that extends further, distally away from the mount brackets 24 than the suspension shelf 20. In another example, length L may extend further than frame 30 distally away from a support 12 and/or mount brackets 24. Length L may contribute to the stability of the handing hose reel and/or the stand when the weight of a hose is supported on spool 50. The longer length L makes the stabilizer 71 surround an area greater than the shelf 20. This helps locate the center of gravity of the hose on the reel above a point with that area when the reel is at rest and not rolling on wheels 76.

Figure 2:
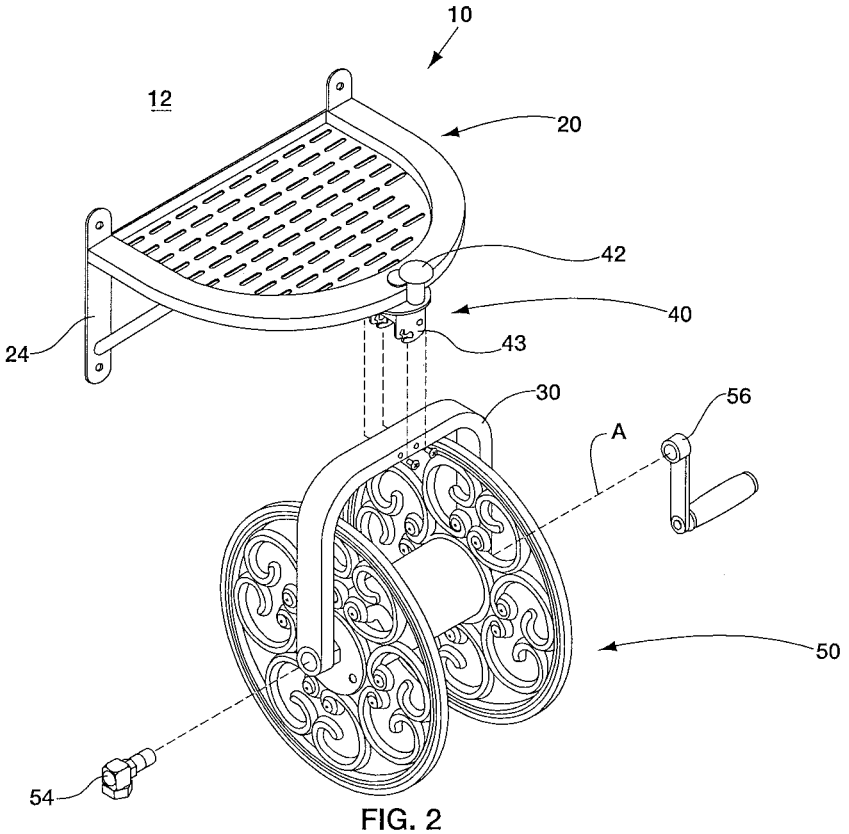
FIG. 2 is an exploded view of one example of the hose reel of FIG. 1.
Figure 4:
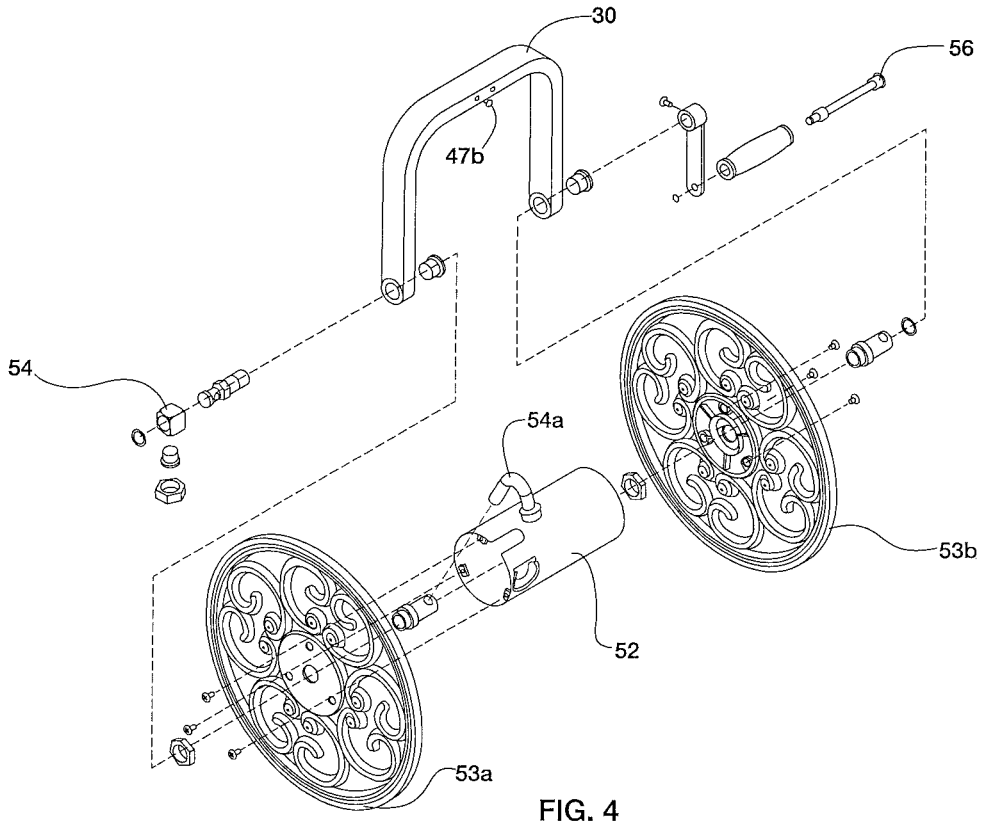
FIG. 4 is an exploded view of one example of a spool of the hose reel of FIG. 1.

Frame 30 provides a bearing so that the hose leader attachment 54 can be supported and thereby supports the spool 50. Frame 30 attaches to rotational assembly 40 and allows rotation of the spool 50 about two axes, one horizontal and one vertical in normal use (see FIG. 3). The frame may be a yoke or may take on varying shapes, such as a gimbal. The frame 30 typically attaches to the spool 50 as shown in FIGS. 1, 2 and 4. The frame may hang from the rotational assembly by supports 47 (see FIG. 3) and/or may be secured by bolts, pins or screws. The screws can be seen in FIG. 3; a notch 47*a* in support 47 is positioned to receive pin 47*b* on the frame as seen in FIG. 4.

Figure 5:
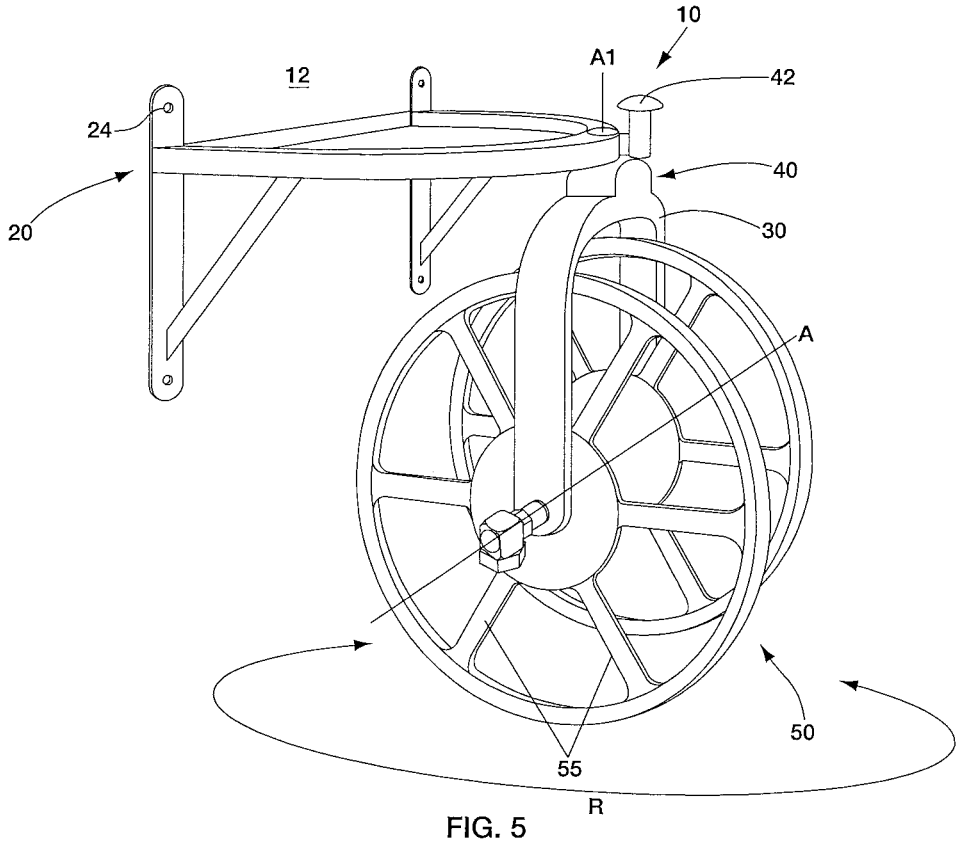
FIG. 5 is a perspective view of another example of a hose reel of the present disclosure.

Rotational assembly 40 interfaces with both suspension shelf 20 and frame 30. Rotational assembly 40 may be integrated with or independent of shelf 20, and/or frame 30. Rotational assembly 40, as seen in FIG. 5, allows the frame 30 and spool 50 to rotate, for example, up to 360 degrees about rotational axis A1. Allowing the spool to rotate about A1 permits the hose to remain on the spool, however, also allows the spool to adjust its azimuth for the hose to be pulled from angles peripherally without the hose kinking, resisting and/or becoming obstructed on the reel when being used. Conventionally-mounted hose reels have a mounted support that attaches to the wall and also directly holds the reel. The conventional configuration, while contributing to stability of the mount, prevents rotational movement of the spool about the vertical axis and thus, flexibility and maneuverability of the hose in use. Applicant's apparatus maintains stability of the mount, while also allowing adjustment of the azimuth of the spool about a vertical axis.

FIG. 3 shows one example of a rotational assembly 40. The rotational assembly may include a stop for restraining the rotation of the spool about the vertical axis. A bracket 43 is pivotally attached to the suspension shelf 20 and rigidly attached to the frame 30, in one example, as shown in FIG. 3. The bracket 43, for example, may be secured by a pivot pin 80 passing through hole 82 in the mount 28. The mount 28 also has a second hole 84 offset from and generally parallel with hole 82. A stop 42 may be mounted in the hole 84. The stop 42, alternatively, may be a part of or independent of the shelf 20, the assembly 40 and/or the frame 30. Stop 42 may include a spring-biased pull pin that settles into an aligned one of receivers 41 on the bracket 43 of the assembly 40. The pull pin and preset-receivers allow the spool 50 to be locked into one of the various azimuthal spool positions around the axis A1. Additional or differently-aligned receivers 41 can be included to permit different azimuthal orientations. If it is preferred that the reel can freely rotate about the vertical axis, the stop 42 and receivers 41 can be omitted.

Figure 10:
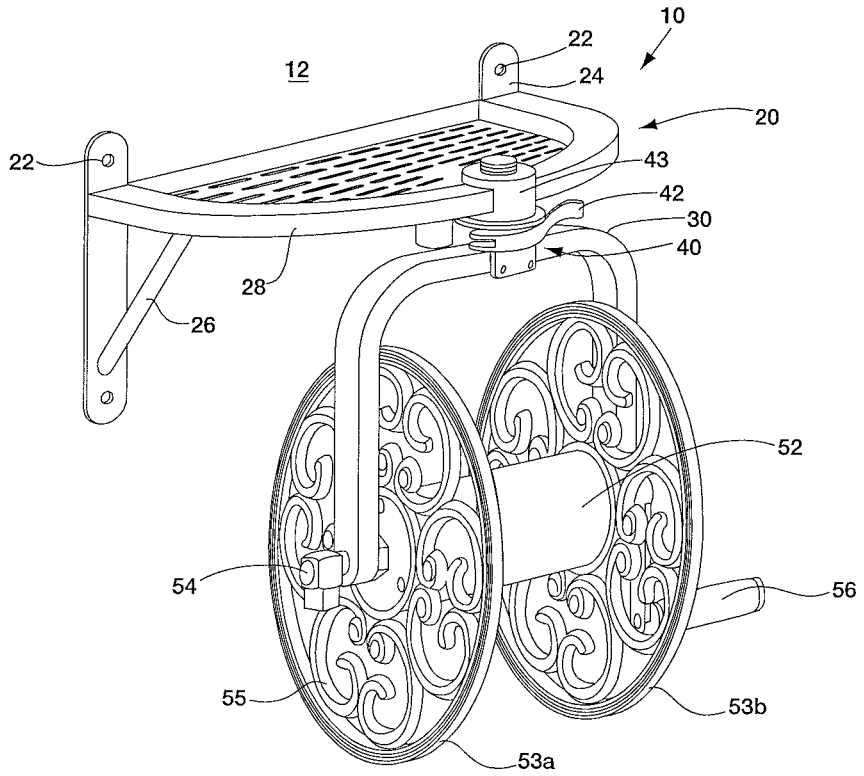
FIG. 10 shows another example of a rotational assembly of the hose reel disclosed.

FIG. 10 shows another example of a rotational assembly. In this example, bracket 43 may be bolted to the suspension shelf 20. A tension stop 42 may be used to control and release the movement of the frame 30 and spool 50. The tension stop may be released to allow free rotation of the spool when in use or may allow adjustment of the spool to a desired position and then tightened to secure the angle of the spool about the vertical axis. In one example, rotation may be up to 180 degrees. In another example, rotation may be up to 360 degrees. In another example, rotation may be free rotation of up to 360 degrees or more. The spool 50 and frame 30 may optionally be made removable from the rotational assembly if the user decides to carry the hose to another desired location.

Figure 6B:
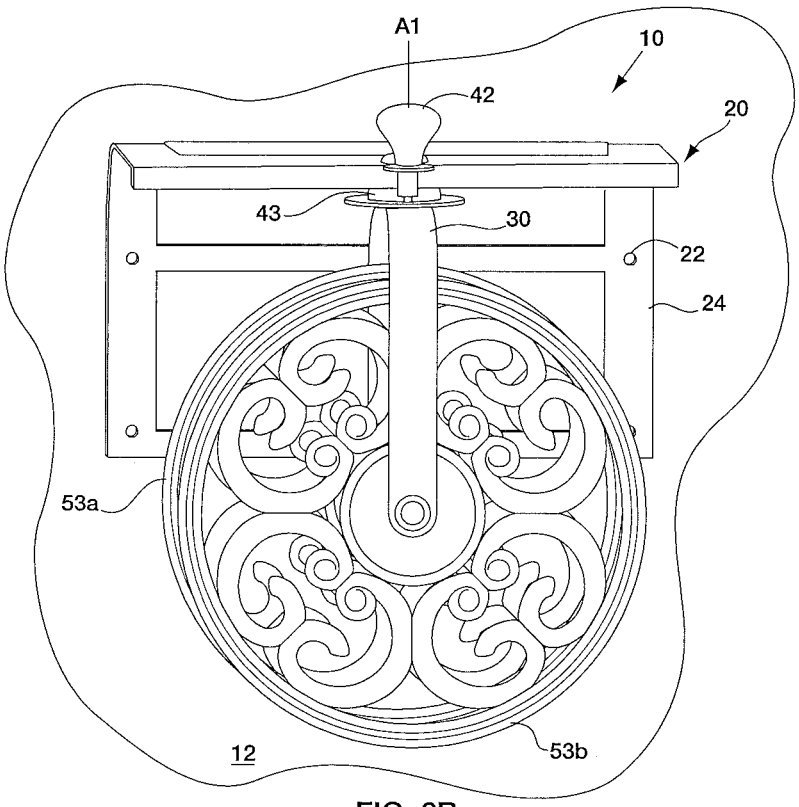
Figure 6C:
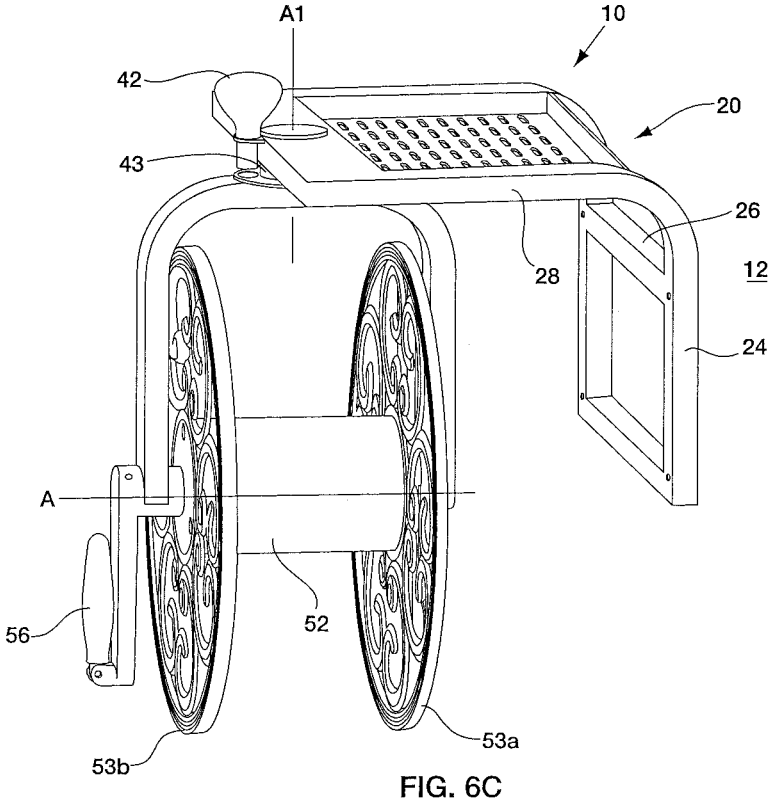

The degree of rotation of the spool about an the vertical axis may be determined by the user. The user can select a position that deviates the spool from a standard stationary spool setting, generally parallel to the support 12, as seen in FIG. 6A or transverse to the support 12 as seen in FIG. 6B. The spool is rotatable between these stationary points or at settings between the parallel or transverse setting and optionally beyond. The spool may alternatively be freely rotatable about A1 in other embodiments. As seen in FIG. 6B, the spool 50 may be positioned to wind and/or unwind hose to the right, or to the left.

Figure 7:
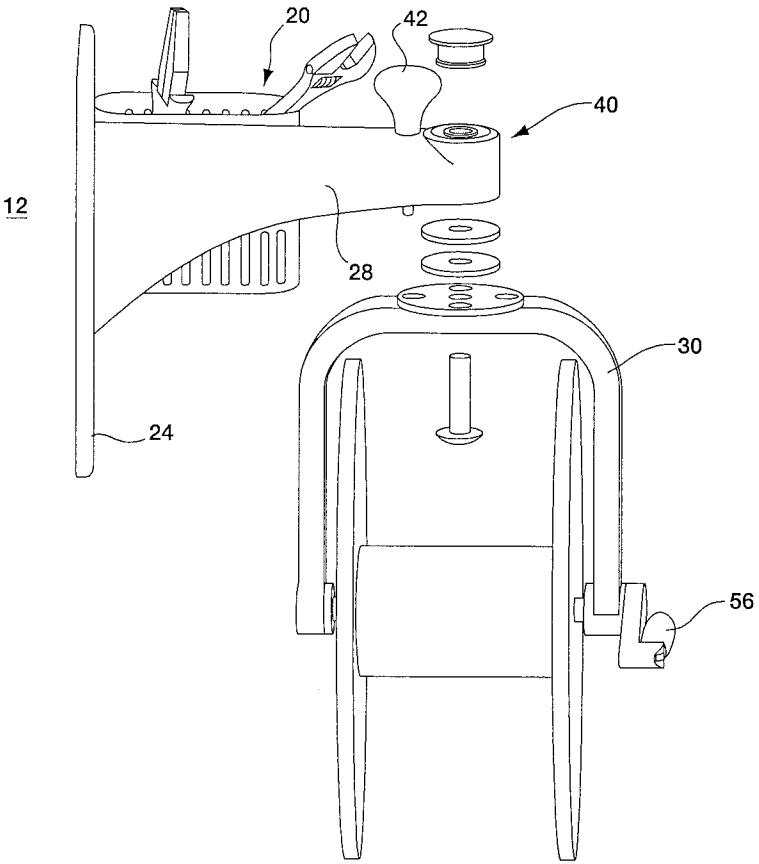
FIG. 7 is an exploded view of another example of a hose reel of the present disclosure.
Figure 9:
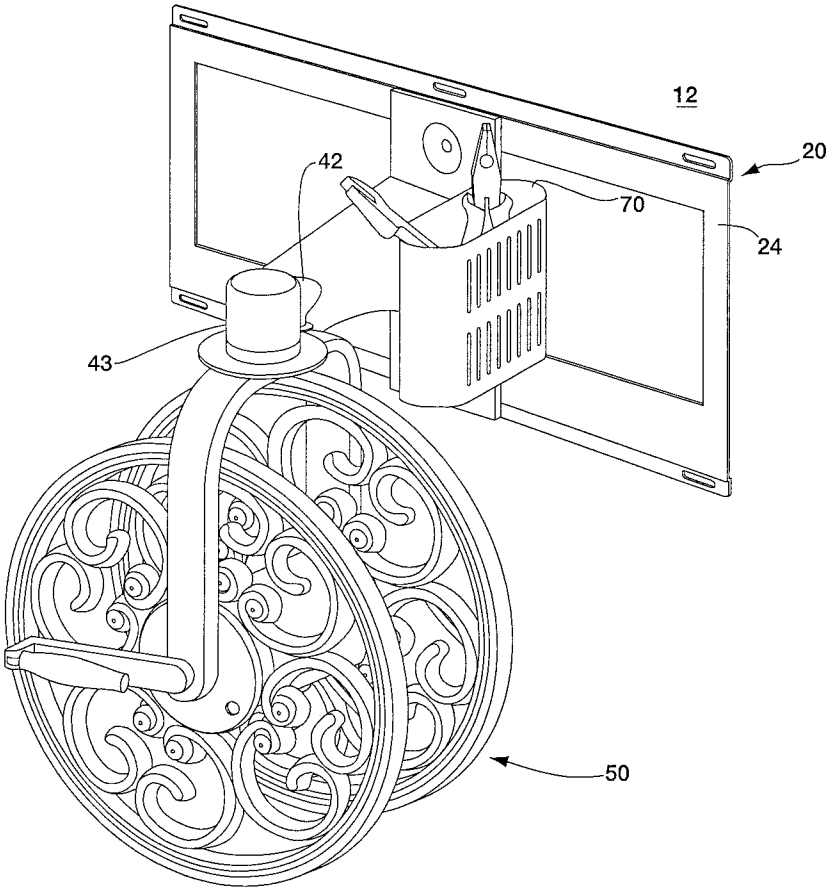
FIG. 9 is another example of a hanging hose reel of the present disclosure.

Certain modifications and improvements will occur to those skilled in the art upon a reading of the foregoing description. By way of example, the rotational assembly may be attached so that the frame and spool are supported in other positions, such as, adjacent to or above the shelf 20. The spool may be supported in various positions when not in use, such as for example, parallel or transverse standard spool settings. As seen in FIGS. 7, 8 and 9, the shelf can be modified greatly, even reduced to a vestigial form. It should be understood that all such modifications and improvements have been deleted herein for the sake of conciseness and readability but are properly within the scope of this disclosure.

We claim:

1. A method of hanging a rotational hose reel, comprising:

mounting a bracket for hanging the hose reel on a support, affixing a spool for winding a hose about a first rotational axis onto a frame, supporting the frame on the spool below the bracket mount;

attaching a rotational assembly between the bracket and the frame, positioning the rotational assembly to allow rotation of the spool about a second rotational axis, pivotally attaching a bracket to the mount, wherein the rotational assembly allows a rotation of the spool about the second vertical axis from about 0 to about 360 degrees, providing a stop for restraining rotation of the spool about the vertical axis at variable selected positions amid the about 0 to about 360 degree rotation, attaching a support to the bracket, and configuring the bracket to suspend the frame.

2. The method of hanging a rotational hose reel of claim 1 including attaching a wall bracket for securing the hanging hose reel to a surface.

3. The method of hanging a rotational hose reel of claim 1 including attaching the bracket mount to a stand for supporting the hanging hose reel.

4. The method of hanging a rotational hose reel of claim 1 including supporting the spool by way of the frame below the bracket and the first rotational axis is perpendicularly intersected by the second rotational axis.

5. The method of hanging a rotational hose reel of claim 4 including allowing a user a rotational selection of between 0 and 360 degrees about the second rotational axis from a stationary setting and retaining the reel at that selection.

6. The method of hanging a rotational hose reel of claim 4 including allowing the rotation of the spool around the second rotational axis to be bidirectional.

7. The method of hanging a rotational hose reel of claim 6 including allowing the hose reel to receive water from a supply faucet.

8. The method of hanging a rotational hose reel of claim 4 including removably attaching the frame and spool to the bracket.

9. The method of hanging a rotational hose reel of claim 1 including configuring at least two receivers to mate with the stop.

10. The method of hanging a rotational hose reel of claim 1 including mounting a stand to a wagon.

11. The method of hanging a rotational hose reel of claim 10 including adding a stabilizer.

12. The method of hanging a rotational hose reel of claim 11 wherein the wagon includes one or more wheels.

13. The method of hanging a rotational hose reel of claim 11 including extending the stabilizer further away from the support than the bracket.

* * * * *